US005078574A

United States Patent [19]

Olsen

[11] Patent Number: 5,078,574

[45] Date of Patent: Jan. 7, 1992

[54] DEVICE FOR MINIMIZING ROOM TEMPERATURE GRADIENTS

[76] Inventor: George D. Olsen, 1255 Hillside Dr., Northbrook, Ill. 60062

[21] Appl. No.: 615,338

[22] Filed: Nov. 19, 1990

[51] Int. Cl.[5] ..... F01D 25/24

[52] U.S. Cl. ..... 415/182.1; 415/211.2; 454/230

[58] Field of Search ..... 415/182.1, 203, 206, 415/208.1, 211.2; 98/31.5, 40.2

[56] References Cited

U.S. PATENT DOCUMENTS

| | | | |
|---|---|---|---|
| 1,372,251 | 3/1921 | Schnee | 415/211.2 |
| 1,577,280 | 3/1926 | Xippas | 415/182.1 |
| 2,420,209 | 5/1947 | Strom | 415/182.1 |
| 2,640,646 | 6/1953 | Jones | 415/211.2 |
| 2,814,433 | 11/1957 | Brinen | 415/210.1 |
| 3,421,687 | 1/1969 | Daily | 415/211.2 |
| 4,347,782 | 9/1982 | Hoecke | 98/31.5 |
| 4,730,551 | 3/1988 | Peludat | 98/31.5 |
| 4,775,294 | 10/1988 | LaPorte | 415/182.1 |

FOREIGN PATENT DOCUMENTS

| | | | |
|---|---|---|---|
| 12739 | 10/1979 | Japan | 98/31.5 |
| 2135046 | 8/1984 | United Kingdom | 98/31.5 |

*Primary Examiner*—John T. Kwon

[57] ABSTRACT

Floor to ceiling room temperature gradients are minimized by a portable floor mounted upstanding tubular unit having air intake ports adjacent the bottom, an open top with air directing louvers, and an electric motor driven fan having blades spanning the interior of the tube above the ports and substantially below the open top. The unit can be positioned on the floor of a room in an out of the way location and will circulate air throughout the room without causing a draft to minimize temperature variations between the floor and the ceiling of the room. The unit receives air adjacent the floor and projects it in a substantially confined upstanding column to the ceiling where it is dissipated throughout the room area to flow back to the intake ports of the unit.

9 Claims, 1 Drawing Sheet

DEVICE FOR MINIMIZING ROOM TEMPERATURE GRADIENTS

BACKGROUND OF THE INVENTION

1. Field of the Invention

This invention relates to the art of maintaining uniform temperatures in room areas without creating drafts and specifically deals with a portable floor mounted upstanding tubular device creating air circulation throughout the room to decrease temperature gradients between the floor and ceiling of the room.

2. Description of the Prior Art

Various fan arrangements have been proposed for room air circulation in an attempt to equalize the temperature throughout the room. House and office rooms are conventionally heated by floor mounted radiators, and wall or floor mounted heated air ducts. In all of these heating arrangements, the warmer air circulates to the ceiling and appreciable temperature gradients between the floor and ceiling will occur. Attempts to force the warmer ceiling area air back to the floor area as by means of ceiling mounted paddle fans are not efficient because the fan blades attempt to reverse the direction of the rising air and must dissipate it laterally. Large volumes of air must be moved causing drafts in the occupied area of the room and requiring costly power input. Also such air circulating fans are not portable and are frequently positioned in ceiling areas where they are not only unsightly but fail to move trapped air because of the room configuration.

It would therefore be an improvement in this art to provide an inexpensive portable floor mounted device operated at low cost adapted to be selectively positioned in a room to efficiently circulate the room air in a floor to ceiling direction without noise or creation of drafts to minimize temperature gradients in the room.

It would be especially an improvement in this art to minimize floor to ceiling temperature gradients in household and office rooms by propelling floor area air in a confined column to the ceiling where the cooler air from the column mixes with the warmer ceiling air and dissipates the mixture back to the occupied area of the room.

SUMMARY OF THE INVENTION

According to this invention, there is provided an inexpensive portable electric motor driven device adapted to be placed on the floor in an out of the way location of a room to receive floor area air, propel it in a substantially vertical column to the ceiling area of the room and create a noiseless air circulation without a draft which will maintain uniformity of room temperatures throughout the occupied area of the room. The device of this invention, contrary to known air circulating fans, receives cooler air from the floor area of a room, blows the air in a confined column to a top outlet which directs an air column to the ceiling without substantial dissipation. The device includes an upstanding tubular housing with air inlet ports adjacent the bottom, and preferably around the periphery of the housing, and having an open top with upstanding louvers. An electric motor driven fan is mounted in the housing to position the fan blades closely adjacent but above the ports so that air propelled by the blades is confined in a column in the housing before leaving the open top of the housing where it is directed by the louvers to rise to the ceiling of the room without substantial lateral spreading.

The device preferably has a cylindrical metal or plastics material housing with a closed bottom adapted to rest on the floor and an open top having a louvered cover or lid with spaced vertical ribs. The periphery of the tubular housing is perforated adjacent the bottom to provide air inlets to the housing.

An electric motor driven fan assembly is mounted in the housing with the fan blades spanning the interior at a level above the inlet ports but substantially spaced below the louvered cover. A cover closes the bottom of the housing, the inlet ports around the periphery of the housing are too small to receive the fingers of a child while the spaces between the louvers of the cover are small enough to prevent the fingers or hand of a person from reaching the fan blades. A speed sensitive switch controls the motor for the fan and an electric cord projects from the bottom of the housing with a plug end to be inserted in an electric socket.

The preferred cylindrical housing is only about 10–16 inches in height with a diameter of about 6–12 inches. A preferred dimension is 12 inches high and 8½ inches in diameter.

The gap between the fan blades and the top outlet of the housing is preferably at least ½ the height of the housing and in the order of about 5–8 inches. This gap confines the air propelled by the fan blades into a cylindrical column which is maintained by the louvers to rise without substantial lateral dispersion to the ceiling of the room.

The fan blades radiate from a central hub carried on the drive shaft of an electric motor and are sufficient in number and so pitched to create a very quite air flow. In a preferred embodiment, 6–12 fan blades radiate from a central hub into close spaced relation wit the interior wall of the housing so as to deliver large volumes of air at relatively low speeds and without noise.

A preferred embodiment of the invention is illustrated on the annexed drawings in which.

BRIEF DESCRIPTION OF THE PREFERRED EMBODIMENT

Figure 1:
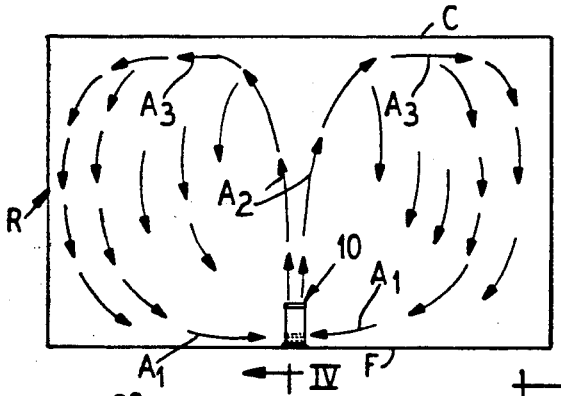
FIG. 1 is a schematic side elevational showing of a room equipped with a device of this invention showing the air circulation created by the device between the floor and ceiling and along the length of the room.
Figure 2:
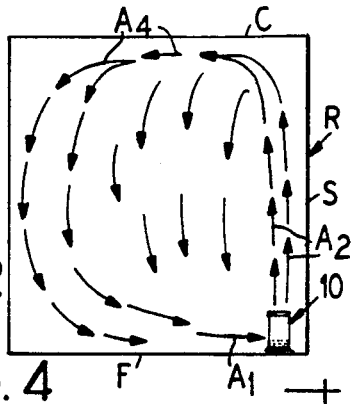
FIG. 2 is a schematic end view showing of the width of the room of FIG. 1 with the device mounted adjacent one of the side walls and showing the air circulation across the width of the room.

The device 10 of this invention is illustrated in the schematic showings of FIGS. 1 and 2 as mounted in a room R on the floor F and circulating air from the floor area to the ceiling C. The device 10 conveniently rests on the floor F midway of the length of the room as shown in FIGS. 1 and adjacent a side wall S of the room as shown in FIG. 2. As shown in by the arrows $A_1$, air is drawn into the lower portion of the unit 10 and propelled upwardly in a substantially vertical column $A_2$ without appreciable lateral spreading to area adjacent the ceiling C where it is deflected laterally as indicated at $A_3$ in FIG. 1 and forwardly as indicated at $A_4$ in FIG. 2. These air streams mix with the warmer air at the ceiling area and are dispersed back downwardly to the floor area over the entire length and width of the room.

Thus the device 10 propels the cooler floor area air in a substantially confined vertical column $A^2$ adjacent a side wall to the ceiling area where it is disbursed to mix with the warmer ceiling air and then descend uniformly to the occupied area of the room and back to the intake of the device. The device 10 is preferably positioned in the room adjacent a wall or in a corner so that the air column $A_2$ will not be obstructed by furniture, drapes, or felt by occupants in the room. The optimum position can be determined for each room to deliver the most effective air circulation.

Figure 3:
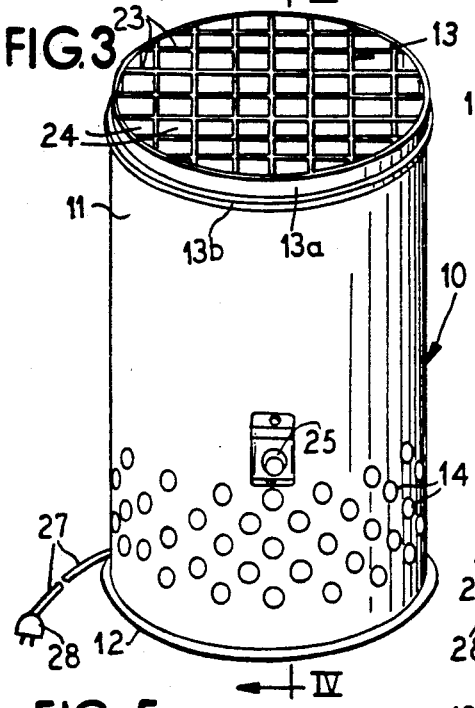
FIG. 3 is a perspective view of the device of this invention.
Figure 4:
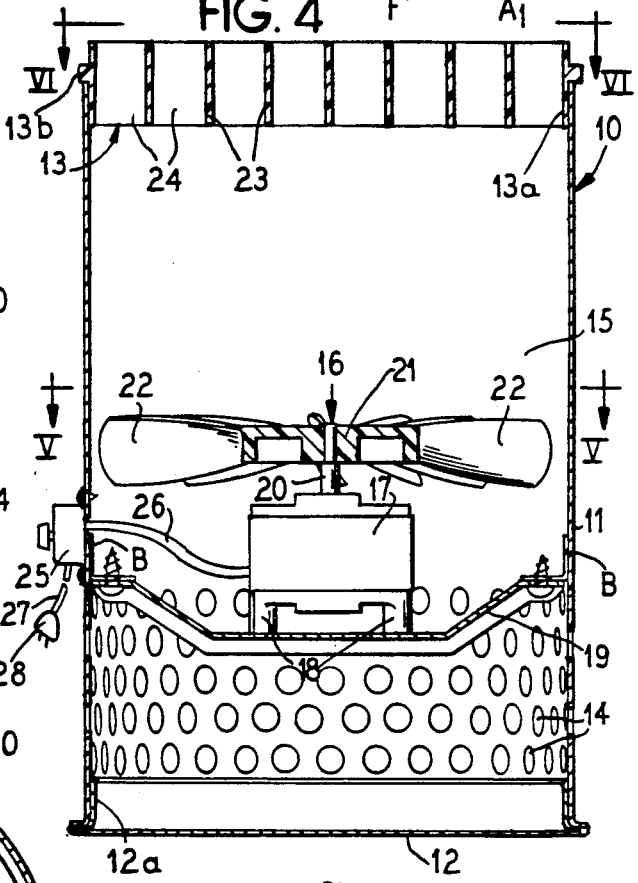
FIG. 4 is a vertical cross-sectional view along the line IV—IV of FIG. 3.
Figure 5:
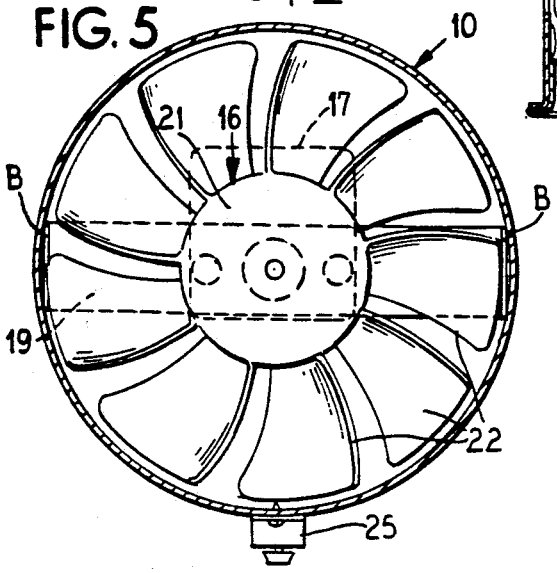
FIG. 5 is a transverse cross-sectional view along the line V—V of FIG. 4.
Figure 6:
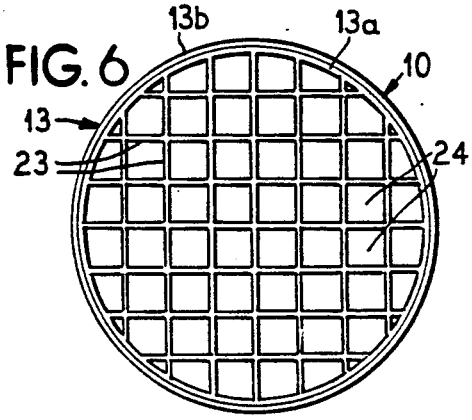
FIG. 6 is a top plan view along the line VI—VI of FIG. 4.

As shown in FIGS. 3 and 4, the device includes an upstanding cylindrical canister or housing 11 with a bottom cap 12 and a top louvered cover or lid 13.

Circumferentially spaced holes 14 are formed around the periphery of the canister 11 to provide air inlets or ports to the cylindrical interior 15. These holes or ports preferably are only about a ¼" in diameter to prevent a child's finger from reaching the interior 15 of the canister.

A motor driven fan assembly 16 is mounted in the axial center of the interior 15 above the ports 14 and substantially below the lid or cover 13. This assembly 16 includes an electric motor 17 with depending legs 18 bolted to a narrow strap 19 spanning the interior 15 and secured by screws to brackets B mounted on the interior wall of the canister as by welding, rivets, or the like.

The motor 17 has a vertical drive shaft 20 protecting upwardly therefrom and the hub 21 of a fan blade assembly 22 is secured to this shaft just above the motor. The fan blades span the entire interior 15 of the canister 11 so that the tips of the fan blades have a relatively close running clearance with the side wall of the canister 11. The fan blades are circumferentially closely spaced around the periphery of the hub and are pitched to pull air inwardly through the ports 14 and propel it upwardly through the confined cylindrical gap area in the interior 15 between the blades and the lid 13. This confined imperforate area or gap between the blades and the lid maintains the air in a vertical confined column.

The lid 13 has checkerboard crossed upstanding vertical louvers 23 defining openings 24 therebetween which are too small to receive a person's hands even though the fingers may pass through the holes. However, any finger passed through the holes 24 cannot reach the fan blades 22. The user is thus protected against inadvertent access to the interior 15 through either the ports 14 or the lid 13.

The louvers are effective to arrest any whirling action of the column of air being propelled by the blades through the upper portion of the canister so that the air column $A_2$ as shown in FIGS. 1 and 2 is substantially devoid of rotary or circumferential movement.

The bottom cover 12 can be conveniently secured to the bottom of the canister 11 through an upturned flange or lid 12*a* press fitted or otherwise secured to either the inner or outer face of the canister bolt and adapted to be pried off to reach the fan motor for oiling.

The lid 13 has a peripheral wall 13*a* pressed into the open top of the canister in friction gripped relation but adapted to be pried off to also give access to the interior of the canister if needed. An external rim or bead 13*b* around the periphery 13*a* is bottomed on the top edge of the canister.

A speed control switch 25 is conveniently mounted on the canister 11 with an interior wire connection 26 to the motor 17 and an exterior wire connection to a cord 27 having a plug 28 adapted to be inserted in a convenient electrical outlet of the room R.

The switch may be of the rotating rheostat type to finely adjust the speed of rotation of the fan for low power consumption so that the device will be quiet and the air circulation will not create a draft. The speed level is adjusted to meet conditions of different rooms in which the device may be used.

From the above description, it will be apparent to those skilled in this art that the device of this invention, contrary to conventional room air fans, circulates cooler air from the floor area of the room, propels it in an upright column to the ceiling area of the room to mix with the warmer ceiling air and descend back to the floor area. Temperature variations in the room are minimized and since the normally accumulated warm air in the ceiling area above the occupied area of the room is recirculated back to the occupied area, a considerable saving in heating or cooling cost is effected. The cost of operating the fan is minimal.

I claim as my invention:

1. A device adapted for minimizing temperature gradients in rooms which comprises an upstanding open top tubular canister adapted to be mounted on the floor of a room, air inlet ports in the canister adjacent the bottom thereof, a lid on the top of the canister having spaced louvers spanning the canister with upstanding vertical openings therebetween, an electric motor driven fan assembly mounted in the canister above the inlet ports and substantially below the lid having fan blades spanning the interior of the canister receiving air from the air inlet ports, and said device adapted to receive air from the floor area of a room, propel the air upwardly in a confined vertical path in the canister to exit through the openings between the louvers as a vertical column of air rising to the ceiling area of the room to mix with warmer ceiling air and dissipate downwardly to the occupied area of the room and thence flow back to the inlet ports.

2. The device of claim 1, wherein the ports are small holes in the periphery of the canister.

3. The device of claim 1, wherein the spaced louvers are composed of crossed upstanding vertical ribs with open ended vertical passageways therebetween.

4. The device of claim 1, including a closed bottom cover on the canister.

5. The device of claim 1, including a strap spanning the interior of the casing mounting the motor of the fan assembly without blocking air flow between the air intake ports and the lid.

6. The device of claim 1, wherein the casing is a cylindrical tube about 10–16 inches high and about 6–12 inches in diameter.

7. The device of claim 1, wherein the fan assembly has 6–12 blades radiating from a central hub driven by the motor.

8. A portable lightweight air circulating device for minimizing temperature variants in a room which comprises an upstanding open top tubular casing adapted to rest on the floor of the room at a convenient location, said casing having peripheral inlet ports adjacent the bottom thereof, a removable louvered lid spanning the open top of the casing and having upstanding vertical openings between the louvers, an electric motor fan assembly having an upstanding motor mounted in the axial center of the interior of the casing and fan blades communicating with the inlet ports driven by the motor spanning said interior above the motor and substantially below the open top of the casing, and said motor fan assembly adapted to draw air through the ports, propel the air upwardly through the casing beneath the louvered lid and force the air through the openings between the louvers.

9. The device of claim 8, wherein the louvers of the lid are upstanding crossed ribs with vertically upright openings therebetween.

* * * * *